US005941693A

United States Patent [19]

Kato

[11] Patent Number: 5,941,693

[45] Date of Patent: Aug. 24, 1999

[54] SWASH-PLATE COMPRESSOR WITH GROOVES FOR LUBRICATING OIL

[75] Inventor: Shigeki Kato, Aichi-ken, Japan

[73] Assignee: Kabushiki Kaisha Yunikura, Aichi-ken, Japan

[21] Appl. No.: 08/755,987

[22] Filed: Nov. 25, 1996

[30] Foreign Application Priority Data

Jul. 9, 1996 [JP] Japan ..... 8-196971

[51] Int. Cl.[6] ..... F04B 1/12

[52] U.S. Cl. ..... 417/269; 92/71

[58] Field of Search ..... 417/269; 92/71; 91/57, 499; 184/6.17

[56] References Cited

U.S. PATENT DOCUMENTS

| | | | |
|---|---|---|---|
| 3,930,758 | 1/1976 | Park | 417/269 |
| 4,392,788 | 7/1983 | Nakamura et al. | 417/269 |
| 4,522,112 | 6/1985 | Nomura | 92/71 |
| 5,044,892 | 9/1991 | Pettitt . | |
| 5,495,789 | 3/1996 | Ogura et al. | 92/71 |
| 5,733,107 | 3/1998 | Ikeda et al. | 417/312 |
| 5,772,407 | 6/1998 | Kato et al. | 417/269 |
| 5,782,316 | 7/1998 | Kobayashi et al. | 184/6.17 |
| 5,807,076 | 9/1998 | Kawaguchi et al. | 417/228 |

FOREIGN PATENT DOCUMENTS 6-101641 4/1994 Japan .

OTHER PUBLICATIONS

Taiwanese Official action, May 27, 1998 with two–page English–language translation, issued in connection with corresponding Taiwanese application.

*Primary Examiner*—Timothy S. Thorpe
*Assistant Examiner*—Ehud Gartenberg
*Attorney, Agent, or Firm*—Hancock Meininger & Porter, LLP

[57] ABSTRACT

A swash-plate compressor having at least one groove formed on the inner wall surface of the housing, or at least one groove provided on the peripheral wall surface of the cylinder block. The groove is communicated with a hole provided in the cylinder block from the level of the lubricating oil collected in the bottom portion of the housing. The hole is communicated with a peripheral groove provided in the piston, while the peripheral groove communicates with a dent for receiving or accommodating a part of the swash plate provided in the piston.

5 Claims, 5 Drawing Sheets

SWASH-PLATE COMPRESSOR WITH GROOVES FOR LUBRICATING OIL

BACKGROUND OF THE INVENTION

1. Field of the Invention

This invention relates to a swash-plate compressor to be used for an automobile air conditioning system.

2. Description of the Related Art:

There is a swash-plate compressor among compressors incorporated into an automobile air conditioning system to perform a compressing operation upon receipt of a rotational power of a vehicle engine. In the swash-plate compressor, a rotating motion of a shaft rotated upon receipt of a rotational power of the engine is converted into reciprocal motions of a plurality of pistons disposed around the shaft disposed in parallel thereto.

Due to this conversion of motions, a circular swash plate is mounted on the shaft to diagonally intersect the shaft, and each piston is provided with a dent for partially receiving the swash plate. The swash plate and each piston is in contact through bearing members disposed in the dent, and thrust bearings for reducing a rotary resistance of the swash plate is disposed around the shaft.

The swash plate rotates together with the shaft, and during the rotation, the position of each portion in the axial direction of the shaft relative to the peripheral direction of the swash plate varies. Consequently, each piston contacting the swash plate is forcibly displaced in the axial direction and reciprocates. As a result, in the automobile air-conditioning system, a refrigerant supplied from the exterior to the interior of the housing of the compressor is compressed, and the compressed refrigerant is discharged to the exterior of the housing.

In the swash-plate compressor, when its operation is started, the lubricating oil collected on the bottom of the housing partially enters the dent of each piston through the swash plate, while evaporating ingredients of the lubricating oil as well as the refrigerant enters the dent of each piston, to be used for lubrication between the swash plate and the bearing members as well as the thrust bearings. As a matter of fact, however, there were such cases as a seizure which occurred in a short time after an operation was started between the swash plate and the bearing member or between the race(s) and ball(s) of the thrust bearing, thereby stopping the operation of the compressor. This is because the supply of the lubricating oil between the swash plate and the bearing members as well as to the thrust bearings is not sufficient.

In view of this, it has been heretofore proposed to add another supply route for lubricating oil. The supply route includes a plurality of holes communicating with a screw hole provided at the shaft and opening at its one end and opening toward the thrust bearing (Japanese Patent Appln. PD No. 6-101641).

According to this, after the operation of the swash-plate compressor is started, evaporating ingredients of the lubricating oil on the bottom of the housing flow into the thread groove opening at one end of the shaft together with the refrigerant running inside the housing to be led from the thread groove to the thrust bearings and between the swash plate and the bearing members through the holes, and the lubricating oil attached to the thread groove and liquidized is fed into each hole through the thread groove, following the rotation of the shaft, to be supplied from the hole to the thrust bearings by the centrifugal force of the shaft, and furthermore, supplied between the swash plate and the bearings through the surface of the swash plate by the centrifugal force. Even by this, a seizure is sometimes caused, and the lubricating oil to these portions was not sufficiently refilled.

SUMMARY OF THE INVENTION

An object of the present invention is to introduce lubricating oil abundantly into dents of pistons partially receiving a swash plate of a compressor in a short time after starting its operation.

The swash-plate compressor comprises a housing and a cylinder block housed in the housing. The cylinder block defines passages for refrigerant in the upper portion of the housing in cooperation with the housing, and includes a plurality of cylinders provided at intervals around its axis and extending in the axial direction. The cylinder block is provided with holes, each communicating with a corresponding cylinder and opening around the cylinder block. A shaft penetrates the cylinder block along its axis and is supported rotatably by the cylinder block. The swash plate is secured to the shaft and can rotate together with the shaft. Inside each cylinder of the cylinder block is disposed a piston capable of reciprocating in the axial direction of each cylinder. Each piston has a dent for partially receiving the swash plate and a peripheral groove facing each hole of the cylinder block.

In the present invention, the housing has at least one groove formed on the inner wall of the housing or the peripheral wall of the cylinder block. The groove of the housing extends upward from below the level of the oil collected on the bottom portion of the housing and communicates with at least one hole of the cylinder block. Also, the groove of the cylinder block extends upward from below the level of the oil collected on the bottom portion of the housing and communicates with one of the plurality of holes of the cylinder block. The groove can be provided on both the inner wall of the housing and the peripheral wall of the cylinder block. The groove on the inner wall of the housing and the groove on the peripheral wall of the cylinder block can extend without confronting each other.

The groove can be formed to have, for example, a triangular cross-sectional shape, each groove having the width and the depth of about 2 mm and about 1 mm, respectively, and the interval between both the grooves can be set at about 2 mm.

According to the present invention, with the starting operation of the swash-plate compressor, the plurality of pistons commence respective reciprocal motions, whereby refrigerant sucked from the outside of the housing into its inside flows into each cylinder, passing through the passages in the upper portion of the housing, is compressed and discharged out of the housing.

When the refrigerant runs through the passages, the pressure of the upper space of the housing lowers than the pressure in the bottom space thereof. Due to this, the lubricating oil collected on the bottom portion of the housing rises along the groove formed on the inner wall of the housing or the groove formed on the peripheral wall of the cylinder block. The lubricating oil, having moved upward through the groove, drops or flows into the holes of the cylinder block. The lubricating oil, having flowed into the holes, flows into the dents of the pistons through the peripheral grooves of the pistons facing the holes. Thereby, the lubricating oil on the bottom portion of the housing is continuously and abundantly introduced into the dents of the pistons in a short time after the compressor starts operating. As a result, bearings disposed in the contact portions of the swash plate and the cylinder block portion or the piston receive a sufficient refill of the lubricating oil, thereby preventing a seizure in the contact portions.

By changing the number, width, depth, sectional shape and the like of the grooves, the quantity of the lubricating oil to be introduced into the dents of the pistons can be changed.

DESCRIPTION OF THE PREFERRED EMBODIMENTS

Figure 1:
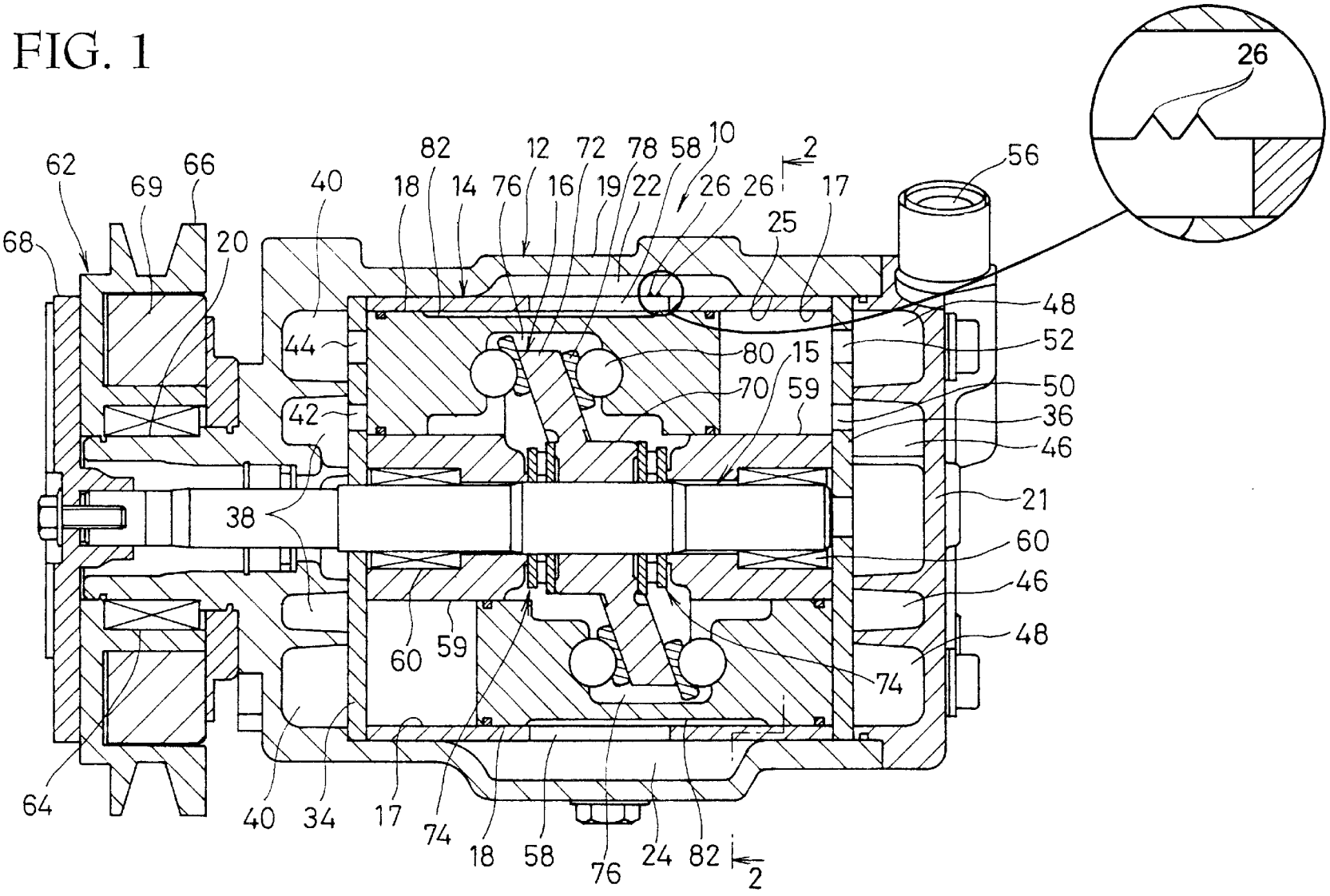
FIG. 1 is a vertical section of the swash-plate compressor of the present invention.
Figure 2:
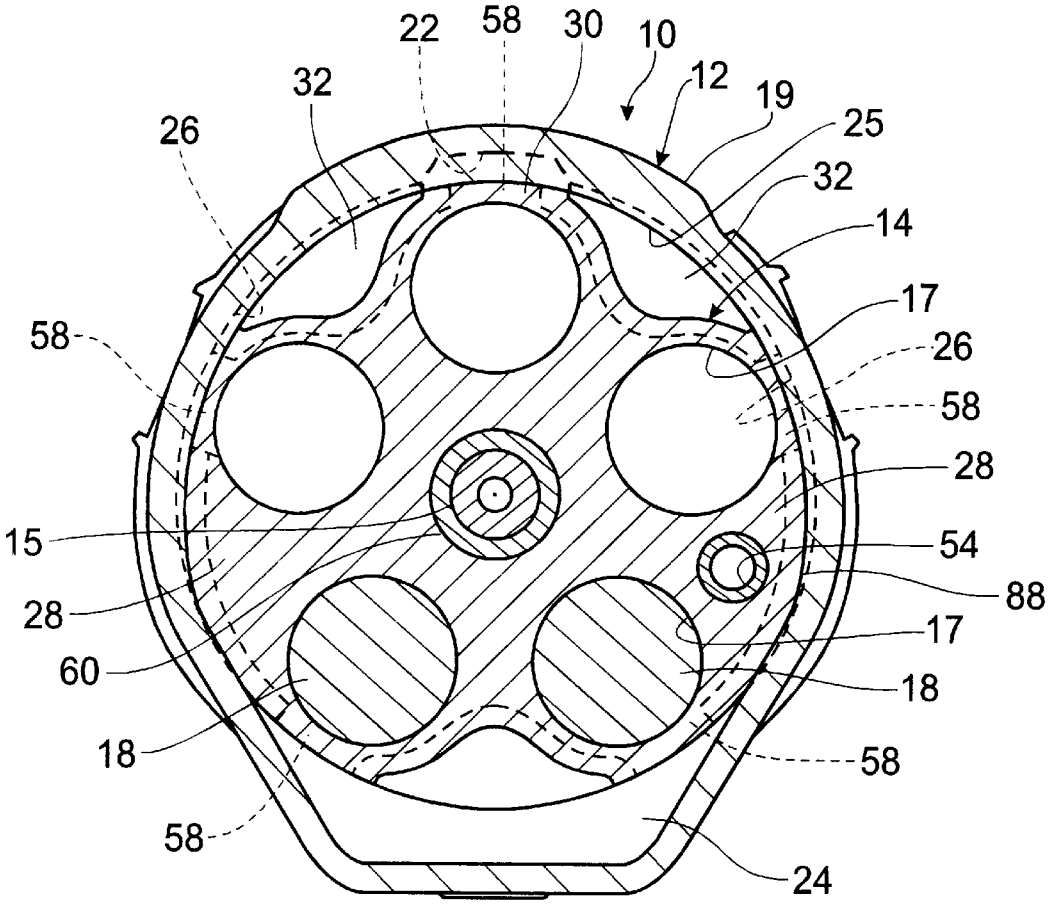
FIG. 2 is a transverse cross-section obtained along the line 2—2 of FIG. 1.

Referring to FIGS. 1 and 2, a swash-plate compressor is generally shown by a reference numeral 10.

The swash-plate compressor 10 comprises a housing 12, a cylinder block 14 housed in the housing 12, a shaft 15 supported rotatably by the cylinder block 14, a swash plate 16 secured to a shaft 15, and a plurality of pistons 18 disposed respectively within a plurality (five in the illustrated embodiment) of cylinders 17 provided in the cylinder block 14.

The housing 12 is composed of a generally cylindrical body 19, a reduced diameter tube portion 20 projecting and extending from one end of the body 19, and a cap 21 fixed at an open end portion (the other end) of the body 19 to cover it.

The body 19 of the housing 12 has two dents 22, 24 in its inside. Both dents 22, 24 are provided respectively on the top and the bottom portions of the body 19, and are positioned in a nearly intermediate portion between both end portions relative to the axial direction of the body 19. The dent 22 of the top portion forms a space for receiving refrigerant to be introduced into the housing 12 through a port (not shown).provided in the body 19. Further, the dent 24 on the bottom portion forms an oil pan. These dents 22, 24 are between valve plates 34, 36 mentioned later defining a closed space inside the body 19, and the lubricating oil is sealed in the closed space. The level of the lubricating oil is usually at the height position below the shaft 15 when the swash-plate compressor 10 stops operating.

Figure 5:
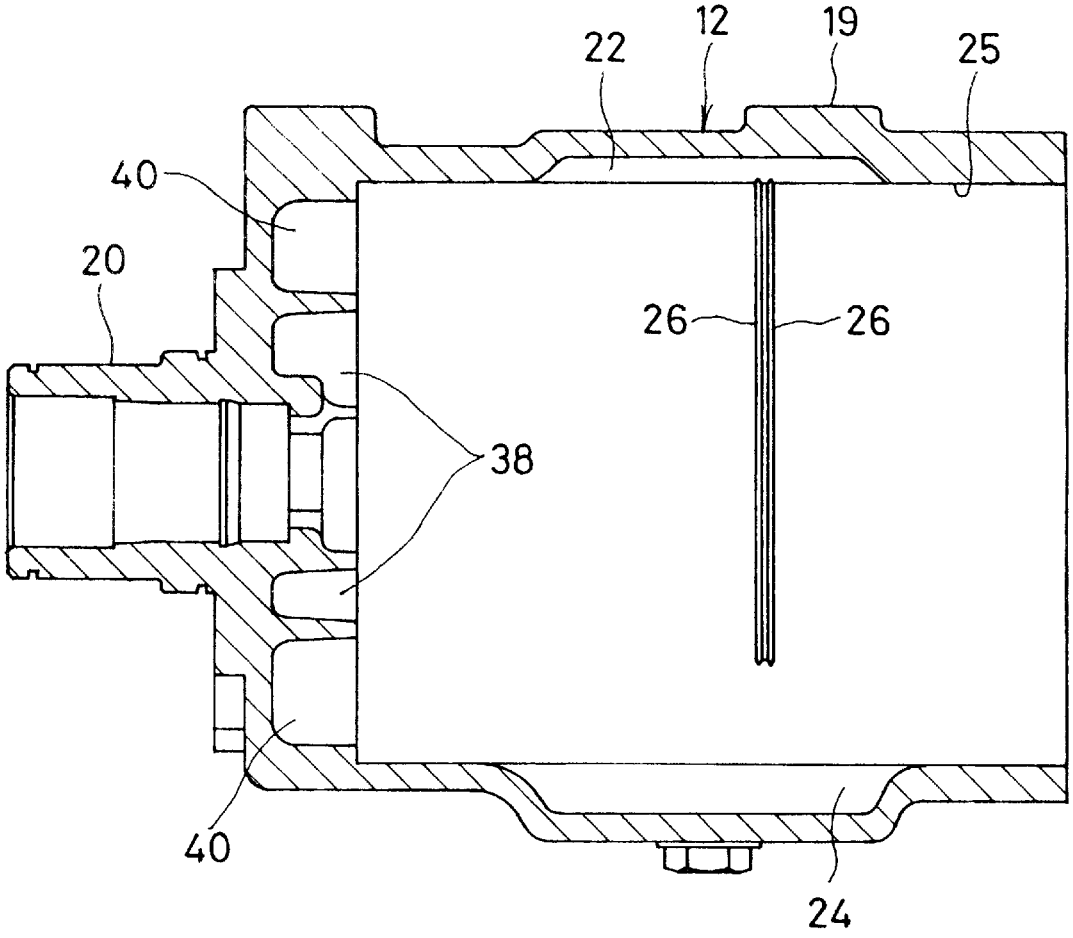
FIG. 5 is a vertical section of the housing body.

As shown in FIGS. 2 and 5, the housing 12 includes a plurality of grooves 26 provided on its cylindrical inner wall 25. As regards the grooves 26, a detailed description will follow.

The cylinder block 14 housed inside the body 19 of the housing 12 contacts the inner wall 25 extending in the peripheral direction of the body 19, and has both side portions 28 defining a part of a cylindrical face and a top portion 30 (FIG. 2). Each side portion 28 and the top portion 30 define passages 32 for the refrigerant extending in the axial direction of the housing 12 in the upper portion of the body in cooperation with the body 19.

A plurality of cylinders 17 provided in the cylinder block 14 are disposed at intervals around the axis of the cylinder block 14. Each cylinder 17 extends in the axial direction and opens at both end faces of the cylinder block 14. Both end faces of the cylinder block 14 contact one end portion of the body 19 and the cap 21 through a pair of valve plates 34, 36.

In the valve plate 34, there are two holes 42, 44 respectively communicating with two coaxial annular spaces 38, 40 provided in the housing body 19. Also, in the other valve plate 36, two holes 50, 52 communicating respectively with each cylinder 17 and two annular spaces 46, 48 provided in the cap 21. As a matter of fact, a check valve (not shown) is provided at each hole 42, 44, 50, 52, and the refrigerant moves between the cylinder and the annular space through the check valve.

By the reciprocal motion in the axial direction of each piston 18 in each cylinder 17, the refrigerant sent out from an evaporator (not shown) forming a part of an automobile air-conditioning system is introduced into the dent or the space 22 on the top of the housing 12, led from the space 22 to inside annular spaces 38, 46 through each passage 32, and further, sucked into each cylinder 17 from each of the annular spaces 38, 46 through each of the holes 42, 50.

The refrigerant compressed by the reciprocal motion of each piston 18 as described above is pushed out into an outer annular space 40, 48 through each hole 44, 52 of the valve plates 34, 36. Both annular spaces 40, 48 communicate with each other via a pipe 54 (FIG. 2) passing through a hole penetrating a cylinder block 14 in its axial direction, and the compressed refrigerant inside both annular spaces 40, 48 is exhausted to the exterior of the compressor 10 through a port 56 connected to one of the spaces 48. The exhausted compressed refrigerant is sent to a condenser (not shown) forming a part of the air conditioning system.

Also, the cylinder block 14 has an elongated hole 58 communicated with each cylinder and extending in the axial direction of the cylinder. Each hole 58 is positioned approximately in the central portion in the axial direction of the cylinder block 14 and opened around the cylinder block 14, that is, in the peripheral surface of the cylinder block 14.

A shaft 15 passes through the cylinder block 14 along its axis through a reduced diameter pipe portion 20 of the housing. In more detail, the shaft 15 passes through a pair of bearing journals 59 (shown in FIG. 1 only) disposed at intervals within the hole provided in the cylinder block 14 and passing through the central portion of the cylinder block 14. The shaft 15 is rotatably borne by the cylinder block 14 through a pair of radial bearings 60. Each radial bearing 60 is supported by each bearing journal 59.

The shaft 15 is rotated upon receipt of a rotational power of a vehicle engine (not shown). The rotational power of the engine is transmitted to the shaft 15 through a clutch 62. The clutch 62 includes a rotor 66 rotatably borne around the reduced diameter tube portion 20 of the housing 12 through a radial bearing 64 and a friction plate 68 confronting the rotor 66 fixed at the tip of the shaft 15 at a small distance.

The rotor 66 of the clutch 62 rotates upon receipt of the rotational power of the engine through a belt (not shown). The rotor 66 has a built-in electromagnet 69 extending annularly around its rotation axis. When the electromagnet 69 is charged with electricity, the friction plate 68 is elastically deformed by the magnetic force emitted from the electromagnet 69 to be brought into contact with the rotor 66. As a result, the friction plate 68 and the shaft 15 secured thereto make a rotating motion.

The rotating motion of the shaft 15 is converted into a reciprocating motion of each piston 18 through a swash plate 16.

The swash plate 16 includes a boss portion 70 passed through by the shaft 15 and secured to the shaft and a disk portion 72 extending from the boss portion 70. The boss portion 70 is disposed between both bearing journals 59, and a thrust bearing 74 is disposed between the boss portion 70 and each bearing journal 59.

The disk portion 72 of the swash plate is inclined to the shaft 15. In other words, the disk portion 72 makes an intersecting angle of other than 90°. Therefore, when the swash plate 16 rotates together with the shaft 15, the position of an arbitrary portion in the circumferential direction of the disk portion 72 varies in the axial direction of the shaft 15.

Each piston 18 disposed within each cylinder 17 of the cylinder block has a dent 76 for receiving the disk portion 72 of the swash plate 16. Inside each dent 76, a disk-shaped shoe 78 contacting each face of the disk portion 72 and a ball 80 held rotatably by the shoe 78 and a wall surface defining the dent 76 are disposed. The disk portion 72 contacts each piston 18 through the shoe 78 and the ball 80.

In view of this, when the swash plate 16 rotates, each piston 18 contacting the disk portion 72 is forced to be displaced in the axial direction of each cylinder by the disk portion and to be reciprocated thereby.

Each piston 18 also has a peripheral groove 82 extending in its circumferential direction. The peripheral groove 82 of each piston is communicated with the dent 76 of each piston. Further, each peripheral groove 82 faces each hole 58 of the cylinder block 14, and therefore, when each piston 18 reciprocates within each cylinder 17, the peripheral groove 82 of each piston is always placed in a communicating relation with each hole 58.

In the illustrated embodiment, two pistons 18 (first pistons) and two cylinders (first cylinders) 17 positioned in a lower level are placed below the level of the lubricating oil. As a result, a part of the dents 76 of these two first pistons 18 is filled with the lubricating oil and, accordingly, it is not necessary to refill the oil to each shoe 78 and ball 80 within these dents 76, though the number of the pistons 18 positioned below the level of the lubricating oil differs depending on the total number and the diameter of the pistons 18.

On the other hand, since the swash plate 16, that is, the tip of the disk portion 72 is partially dipped in part of the lubricating oil, the shoes 78 and the balls 80 within the dents 76 of the remaining three pistons 18 positioned in an upper level are lubricated when the swash plate 16 is rotated by the start of the compressor 10. Further, evaporating ingredients of the lubricating oil generated after the start of the compressor 10 goes into the dent 76 of each piston 18 together with the refrigerant, to lubricate the thrust bearings 74, the contact portion between the shoe 78 and the disk portion 72, though not sufficiently.

The groove 26 of the housing 12 is provided for refilling the lubricating oil to the thrust bearing 74, the contact portion between the shoes 78 and the disk portions 72 in the three pistons in the upper position, that is, the uppermost pistons (second pistons) 18 and two pistons (third pistons) 18 lower than them.

In the illustrated embodiment, two juxtaposed grooves 26 are provided on each side portion of the body 19 of the housing 12. Each of the two grooves 26 extends from a position lower than the lubricating oil level along a cylindrical inner wall 25 upward in its circumferential direction to be opened to upper dents 22. Each of the two grooves 26 crosses each of the two holes 58 communicating with the two cylinders (third cylinders) 17 except the uppermost cylinder (second cylinder) 17 among the upper three cylinders 17. Consequently, each of the two grooves 26 is communicated with the two holes 58 respectively. Also, the upper second cylinder 17 is communicated with the hole 58 relative to the uppermost second cylinder 17 through the upper dents 22.

These grooves 26 define the passages for the lubricating oil collected in an oil pan 24, and the lubricating oil flows upward along the grooves 26 by an action of a negative pressure resulted in the upper space of the housing 12, following the start of the compressor 10.

In more detail, the negative pressure resulted by the flowing of the refrigerant in the upper passage 32 of the housing 12 upon starting operation of the compressor 10. When the lubricating oil rises within each groove 26 of the inner wall of the housing 12, following the generation of the negative pressure, a part thereof drops into each hole 58 relative to the second and third cylinders 17 to reach the dent 76 of each piston along the peripheral groove 82 of each of the second and third pistons 18 communicating with the hole 58. The lubricating oil, having reached the dent 76, directly or indirectly wets each thrust bearing 74 along a bearing journal 59 or the boss portion 70 of the swash plate, and because of a centrifugal force, further wets the shoes 78 and the balls 80 along the disk portion 72 of the swash plate 16 in the radial direction of the disk portion 72.

Thus, the lubricating oil is refilled in the inside of the thrust bearings 74, between the shoes 78 and the balls 80, and between the shoes 78 and the disk portion 72. Besides, since the supply of the lubricating oil continues constantly through each groove 26, these portions and the inside are sufficiently lubricated from immediately after the compressor 10 starts its operation. As a result, a shortage of the lubricating oil within a short time after the compressor starts its operation is made up for, so that a seizure of these portions due to shortage in refilling of the lubricating oil as well as a stoppage in operation of the swash-plate compressor 10 can be prevented.

Since the refilling of the lubricating oil through the grooves can be performed through at least one hole 58 of the cylinder block 14, it is possible to set, in place of the illustrated embodiment where the upper end of each groove 26 has reached the upper dent 22 of the housing, to make the upper end of at least one groove 26 communicate with the hole 58 with respect to either one of the third cylinder 17.

Figure 3:
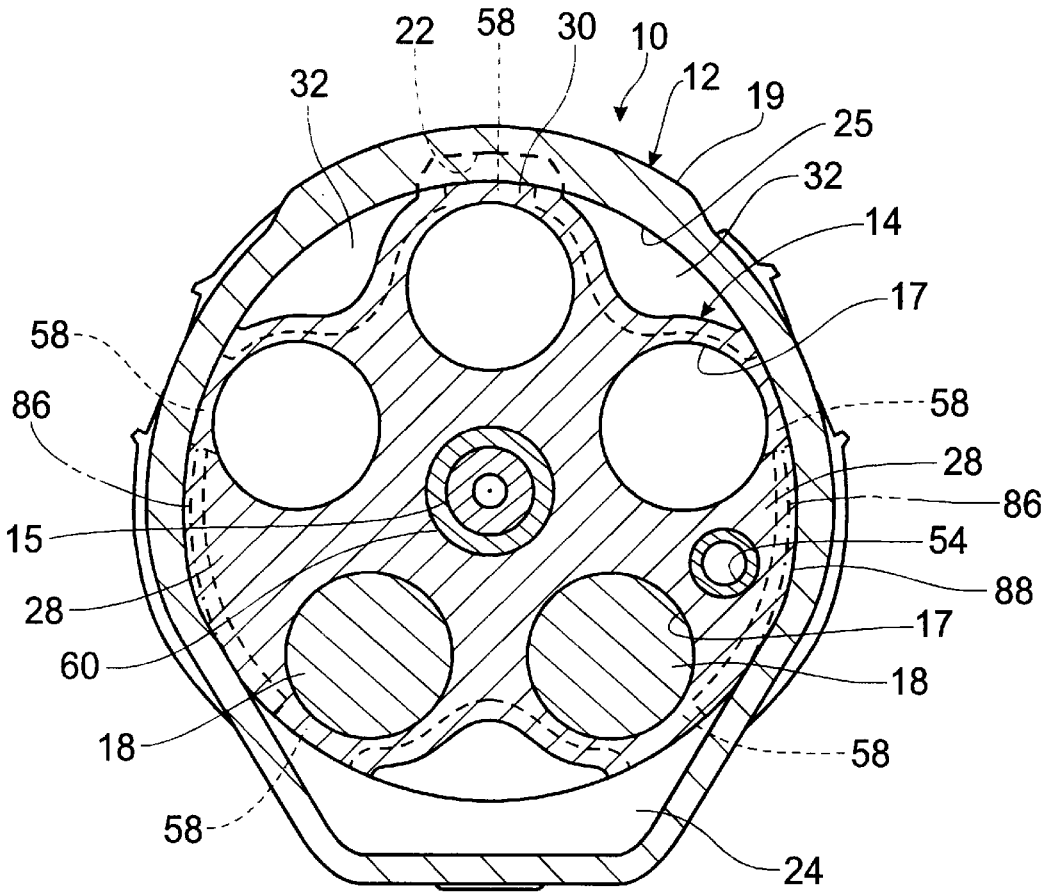
FIG. 3 is a transverse cross-section like FIG. 2, but showing an alternative embodiment.

Also, as shown by an imaginary line in FIG. 3, in place of providing the housing with the grooves 26, it is possible to provide the peripheral wall 88 of the cylinder block 14 with at least one groove 86 similar to the groove 26. In the illustrated embodiment, two grooves 86 are provided in each side portion 28 to extend upward from a position below the lubricating oil level, reaching the hole 58 with respect to each of the third cylinders 17 and communicating therewith. According to this, when the negative pressure occurs to the upper portion of the housing 12, the lubricating oil in the bottom portion of the housing moves along each groove 86 to flow into the dent 76 of the piston through each hole 58 and the peripheral groove of the third piston 82.

Figure 4:
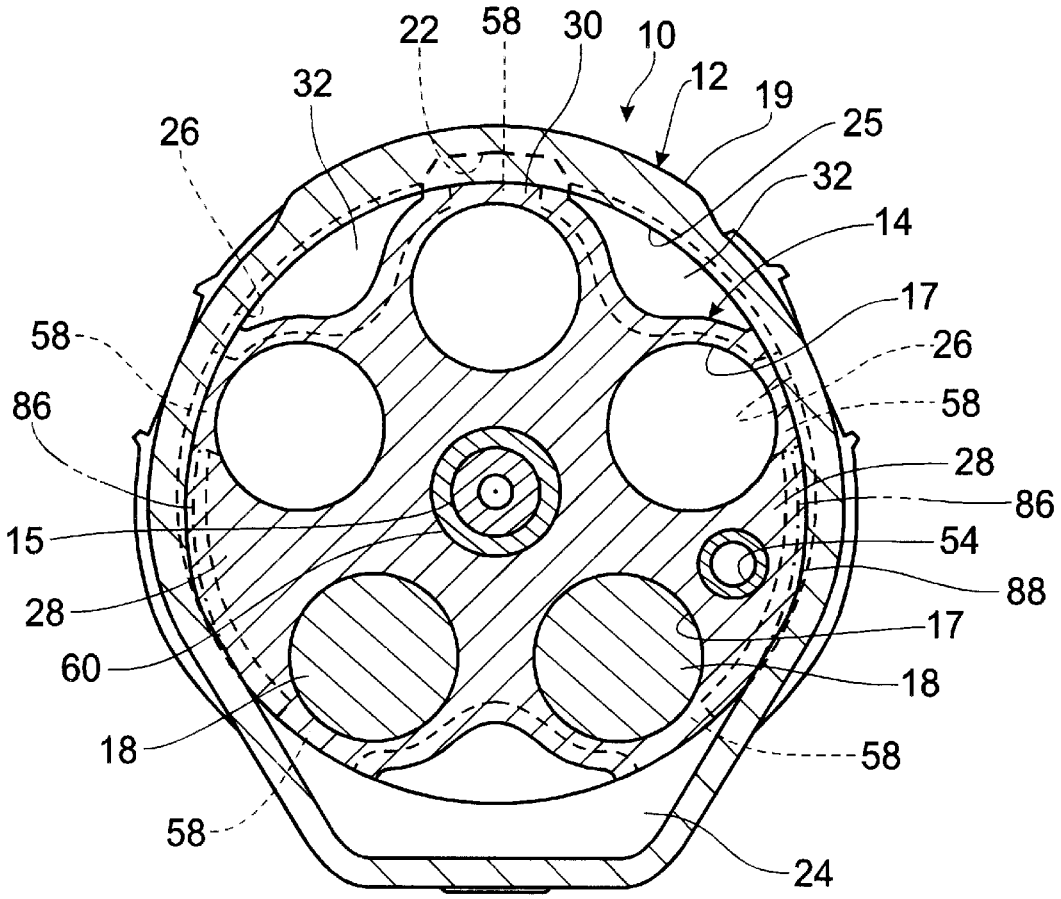
FIG. 4 is a transverse cross-section like FIG. 2, but showing another alternative embodiment.

In addition to the grooves 26 of the housing 12, the grooves 86 of the cylinder block 14 can be provided (FIG. 4). In this case, the grooves 26 and the grooves 86 may have a relation to oppose to each other or not to oppose to each other. The grooves 26 and the grooves 86 may have either the same or different cross-sectional shapes, width dimensions, depth dimensions, distances between the grooves, and the like.

Figure 6:
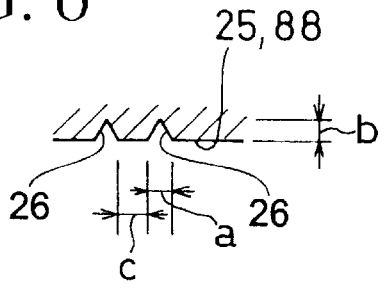
FIG. 6 is an enlarged section of the groove.

Each of the grooves 26, 86 in the illustrated embodiments have triangular cross-sectional shape. The width a (FIG. 6)

of the groove 26, or 86) is about 2 mm, and the depth b thereof is about 1 mm. Also, the distance c between both grooves parallel to each other is about 2 mm. The efficiency in sucking the lubricating oil along the grooves is the best when each dimension is set like this.

In place of the illustrated embodiment, it is possible to provide one groove 26 on the inner wall surface 25 of each side portion of the housing 12 or to provide at least one groove 26 on either one of the inner surfaces 25 of both side portions. In place of the illustrated embodiment, it is possible to provide one groove 86 on the peripheral wall surface 88 of each side portion 28 of the cylinder block 14 or at least one groove 86 on either one of the peripheral wall surfaces 88. The cross-sectional shape of the groove may be rectangular, semicircular or the like in place of the triangular shape. The cross-sectional shape, the width, the depth of the groove, and the distance between the grooves can be decided by taking into account the efficiency in sucking the lubricating oil along the groove.

What we claim is:

1. A swash-plate compressor comprising:

a housing comprising a cylindrical wall having an inner surface;

a cylinder block accommodated in said housing and defining passages in an upper portion of said housing for refrigerant in cooperation with said housing and having a plurality of cylinders provided at intervals about a longitudinal axis of the cylinder block to extend in an axial direction, and a plurality of holes, each hole opened in a circumference of said cylinder block to communicate with each cylinder;

a shaft penetrating said cylinder block along its axis and rotatably borne by the cylinder block;

a swash plate secured to said shaft and rotatable together with said shaft;

a piston disposed within each cylinder of said cylinder block and capable of reciprocating in the axial direction of each cylinder, the piston having a dent for accommodating a part of said swash plate and a peripheral groove communicating with said dent and facing each hole of said cylinder block;

wherein said housing includes at least one groove formed on said inner surface of the housing, and wherein said groove extends upward from a level of lubricating oil collected in a bottom portion of said housing and communicating with at least one of said holes of said cylinder block.

2. A compressor according to claim 1 wherein said cylinder block further includes at least one groove formed on a cylindrical peripheral wall surface of the cylinder block, said groove extending upward from the level of the lubricating oil collected in the bottom of said housing and communicating with one of said holes of said cylinder block.

3. A swash-plate compressor comprising:

a housing;

a cylinder block accommodated in said housing, having a cylindrical peripheral wall, and defining passages in an upper portion of said housing for refrigerant in cooperation with said housing and having a plurality of cylinders provided at intervals about a longitudinal axis of the cylinder block to extend in a axial direction and a plurality of holes, each hole opened in a circumference of said cylinder block to communicate with each cylinder;

a shaft penetrating said cylinder block along said axis and rotatably borne by the cylinder block;

a swash plate secured to said shaft and rotatable together with said shaft;

a piston disposed within each cylinder of said cylinder block and capable of reciprocating in the axial direction of each cylinder, the piston having a dent for accommodating a part of said swash plate and a peripheral groove communicating with said dent and facing each one of said holes of said cylinder block;

wherein said cylinder block has al least one groove formed on said peripheral wall surface of the cylinder block, said groove extending upward from a level of lubricating oil collected in a bottom portion of said housing and communicating with one of said holes of said cylinder block.

4. A compressor according to claim 1, 2, or 3 wherein said groove has a triangular cross-sectional shape.

5. A compressor according to claim 4, including a pair of juxtaposed grooves, each groove having a width of about 2 mm and a depth of about 1 mm, wherein the distance between said grooves is about 2 mm.

* * * * *